US005253439A

United States Patent [19]

Shanok et al.

[11] Patent Number: 5,253,439

[45] Date of Patent: Oct. 19, 1993

[54] PICTURE FRAME AND METHOD OF FORMING SAME

[75] Inventors: Victor Shanok; Jesse P. Shanok, both of New York, N.Y.

[73] Assignee: Silvatrim Associates, South Plainfield, N.J.

[21] Appl. No.: 863,788

[22] Filed: Apr. 6, 1992

[51] Int. Cl.[5] ..... G09F 1/12

[52] U.S. Cl. ..... 40/152; 40/594; 40/156

[58] Field of Search ..... 40/152, 152.1, 594, 40/156, 154, 158.1; 292/251.5

[56] References Cited

U.S. PATENT DOCUMENTS

| | | | |
|---|---|---|---|
| 133,707 | 12/1872 | Hutchinson | 40/155 |
| 799,291 | 9/1905 | Babst | 40/156 |
| 2,045,770 | 6/1936 | Golden | 40/154 |
| 3,553,873 | 1/1971 | Weston | 40/156 |
| 3,736,577 | 5/1973 | Shanok et al. | 292/251.5 |
| 3,899,844 | 8/1975 | Munn | 40/156 |
| 4,583,309 | 4/1986 | Kane et al. | 40/152 |

FOREIGN PATENT DOCUMENTS

| | | | |
|---|---|---|---|
| 214016 | 3/1987 | European Pat. Off. | 40/158.1 |

*Primary Examiner*—Kenneth J. Dorner
*Assistant Examiner*—J. Bonifanti
*Attorney, Agent, or Firm*—Goodman & Teitelbaum

[57] ABSTRACT

A picture frame or photo frame including an extruded L-shaped plastic strip which is notched and bent into a rectangular configuration, a picture frame glass being secured therein, preferably by a double-sided adhesive tape material, and a back plate being removably snapped therein in a locked position against a picture disposed on an inner surface of the picture frame glass. Preferably, ribs are provided on the frame portions to facilitate the snapping in and the holding of the back plate in place, and additional ribs can also be used to secure the picture frame glass therein. The plastic strip can encapsulate a metal strip therein to provide the plastic strip with a particular decorative appearance.

15 Claims, 3 Drawing Sheets

PICTURE FRAME AND METHOD OF FORMING SAME

BACKGROUND OF THE INVENTION

The invention relates to a picture frame or a photo frame and the method of forming same, and more particularly, to an extruded L-shaped plastic strip which is notched and bent to form a rectangular configuration to receive a picture frame glass which is secured thereto, and a snap-in back plate removably locked against a picture disposed on the picture frame glass.

Picture frames and photo frames are well known in the art, where usually the frame portions thereof are separate pieces which are secured together to form a rectangular configuration. The back plates thereof are usually secured to the frame portions by pivotal fasteners, or in some cases the back plates are slid in and held in place by a force-fit engagement, where the back plates function to hold the picture frame glass and the picture in place within the frame portions.

U.S. Pat. No. 133,707 shows the sides of a picture frame notched and hinged together in order to form the frame. U.S. Pat. No. 3,899,844 shows a picture frame having slideable spring clips in the side walls thereof which are reversable to accomodate thick or thin picture mountings.

Accordingly, there is presently a need for a picture frame or photo frame that can be easily and inexpensively manufactured, and assembled, and which provides a simple and quick method for removably securing the back plate therein.

SUMMARY OF THE INVENTION

It is accordingly an object of the present invention to provide a picture frame or photo frame which avoids the problems and disadvantages of the prior art devices.

Another object of the present invention is to provide a picture frame or photo frame which can be formed from an extruded plastic strip.

A further object of the present invention is to provide a picture frame or photo frame, as described above, in which the plastic strip can be notched and bent into a rectangular configuration.

Still another object of the present invention is to provide a picture frame or photo frame, as described above, in which the picture frame glass can be secured to the frame portions thereof.

Another object of the present invention is to provide a picture frame or photo frame, as described above, in which the back plate can be removably snaped therein.

Yet another object of the present invention is to provide a picture frame or photo frame, as described above, which includes rib means on the frame portions to facilitate the snapping in of the back plate.

Another object of the present invention is to provide a picture frame or photo frame, as described above, which includes double-sided adhesive tape material for securing the picture frame glass to the frame portions.

Another object of the present invention is to provide a picture frame or photo frame, as described above, which includes rib means provided on the frame portions for securing the picture frame glass therein.

Yet another object of the present invention is to provide a picture frame or photo frame which can be easily and inexpensively manufactured and assembled, and which permits the user thereof to easily and quickly install a picture or photo therein and to remove same.

Briefly, in accordance with the present invention, there is provided a picture frame or photo frame including an extruded L-shaped plastic strip which is notched and bent into a rectangular configuration, a picture frame glass being secured therein, preferably by a double-sided adhesive tape material, and a back plate being removably snapped therein in a locked position against a picture disposed on the picture frame glass. Preferably, rib means are provided on the frame portions to facilitate the snapping in and the holding of the back plate in place, and additional rib means can also be used to secure the picture frame glass therein. The plastic strip can encapsulate a metal strip therein to provide the plastic strip with a particular decorative appearance.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of embodiments in which.

In the various figures of the drawings, like reference characters designate like parts.

DESCRIPTION OF THE PREFERRED EMBODIMENTS

Figure 1:
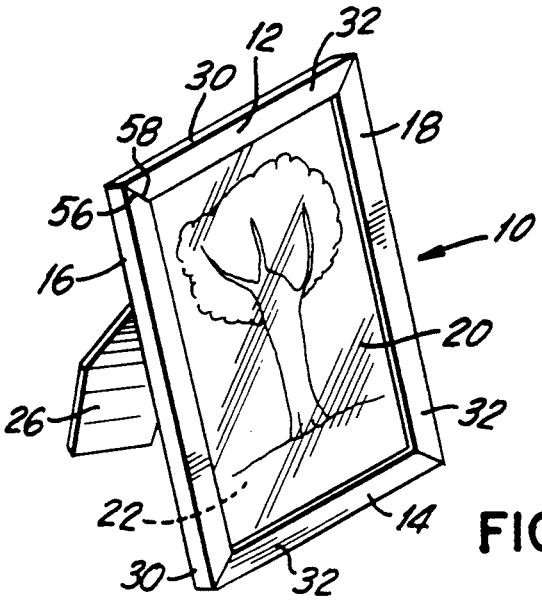
FIG. 1 is a perspective view of a picture frame constructed according to the present invention.

Referring now to the drawings, FIG. 1 shows a picture frame 10 constructed according to the present invention, where the same construction can also be used for photo frames (not shown) in that the parts thereof would be the same. The picture frame 10 includes an upper frame portion 12, a lower frame portion 14 and side frame portions 16, 18 which enclose therein the picture frame glass 20 disposed in front of the picture 22 and held in place by a back plate 24 (see FIG. 12) having a hinged stand portion 26. The construction of the picture frame 10 will now be discussed below.

Figure 2:
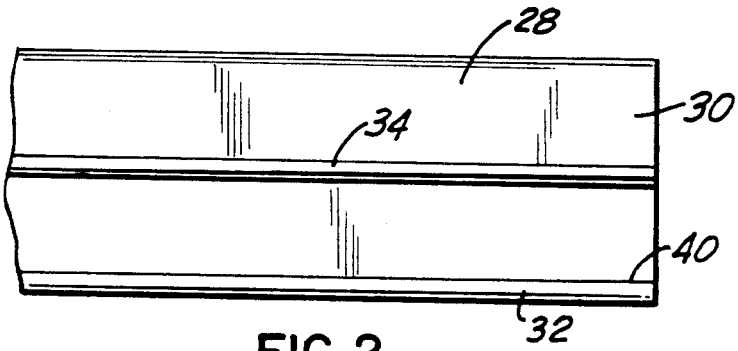
FIG. 2 is a fragmented elevational view of an extruded plastic strip used in the construction of the picture frame of FIG. 1.
Figure 3:
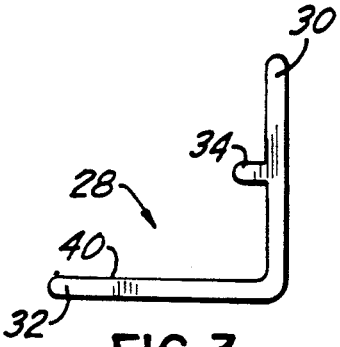
FIG. 3 is an end view of the extruded plastic strip of FIG. 2.

The frame portions 12, 14, 16 and 18 are constructed from a continuous extruded L-shaped strip 28 of thermoplastic material, such as acrynitrile butadiene styrene commonly referred to as ABS. As shown in FIGS. 2 and 3, the extruded L-shaped plastic strip 28 includes a first leg 30 which forms the side edges of the picture frame 10, and a second leg 32 which forms the front portions of the picture frame 10. The first leg 30 has an inwardly projecting rib 34 extruded thereon. It is noted, that the plastic strip 28 can be extruded from one material, such as mentioned above, or can be formed by a twin extrusion where a second additional material can be used to form the rib 34, such as a soft vinyl material of low durometer so that the rib 34 can be easily deformed in its function as mentioned below.

Figure 4:
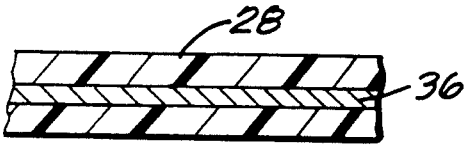
FIG. 4 is a fragmented cross sectional view of one of the legs of the extruded plastic strip shown in FIG. 3.

As shown in FIG. 4, the extruded plastic strip 28 constitutes a casing which is preferably transparent and encapsulates a metallic strip 36, such being well known in the art as disclosed in U.S. Pat. No. 3,730,577 to which reference may be made. The metallic strip 36 extends into both legs 30, 32 for the entire length of the extruded plastic strip 28 so that the extruded plastic strip 28 takes on the appearance of the metallic strip 36. For example, if the metal strip 36 has a silver metal-like finish, then the extruded plastic strip 28 would have a metal appearance, such as found on automobiles and appliances. On the other hand, if the metallic strip 36 has a wood grain finish, then the extruded plastic strip 28 would have the appearance of wood, such as used to decorate the interior of automobiles Accordingly, the metallic strip 36 can be made in any color or texture as desired to provide the extruded plastic strip 28 with a particular decorative appearance. Preferably, the metallic strip is fabricated from a metalized mylar or any other suitable material such as tin foil and the like which is fed in during the extruding process. If desired, the metallic strip 36 can be fabricated from a stiff rigid metal material to strengthen the legs 30, 32 of the extruded plastic strip 28.

Figure 5:
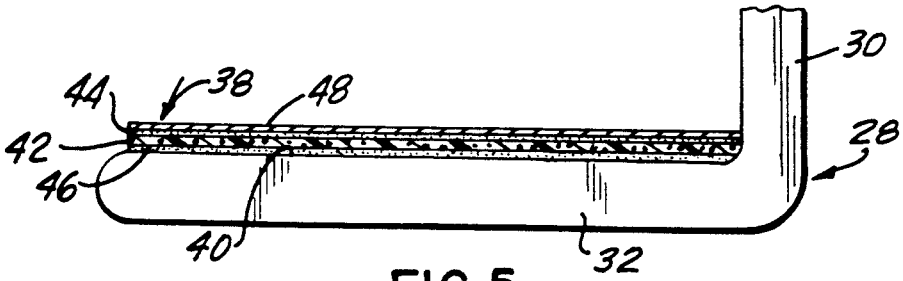
FIG. 5 is a fragmented end view of the extruded plastic strip shown in FIG. 3, showing a double-sided adhesive tape material disposed on one leg thereof.

After the plastic strip 28 has been extruded, a double sided adhesive tape material 38, shown in FIG. 5, is secured to the inner surface 40 of the leg 32 of the plastic strip 28 along the entire length thereof. Such a tape material 38 is commercially available, being manufactured by Mac Tac of Stow, Ohio under the product name MACmount IM-1705 and consists of a thin, one thirty second of an inch, polyethylene foam 42 coated on both sides with a high shear strength rubber based pressure sensitive adhesive 44, 46. The inner adhesive 46 secures the foam 42 to the inner surface 40 of the leg 32. The outer adhesive 44 is protected by a polyethylene coated paper release liner 48 being of the peel-off type.

Figure 6:
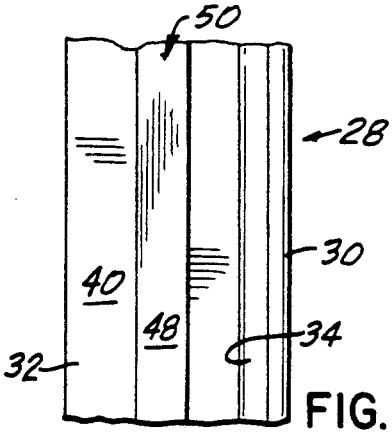
FIG. 6 is a fragmented plan view showing a modified double-sided adhesive tape material disposed on the one leg of the extruded plastic strip.
Figure 7:
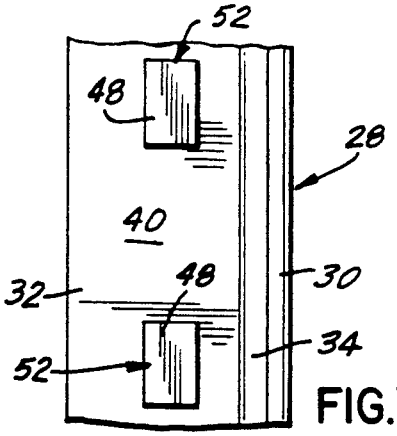
FIG. 7 is a fragmented plan view of a further modification showing spaced apart double-sided adhesive tape materials disposed on top of the one leg of the extruderd plastic strip.

Depending upon the required shear strength, the double-sided adhesive tape material can be made in various predetermined widths and shapes. As shown in FIG. 5, the tape material 38 has a width approximately equal to the width of the leg 32, thereby providing a very high sheer strength. The modified double-side adhesive tape material 50 shown in FIG. 6 has a narrower width than the above-mentioned tape material 38, and therefore provides less sheer strength than that of the tape material 38. FIG. 7 shows a further modification where the double-sided adhesive tape material is in the form of spaced apart rectangularly-shaped tape materials or tabs 52 which preferably have the same width as the above-mentioned tape material 50, and which also extend longitudinally along the entire length of the leg 32. Obviously, if desired, other configurations can also be formed from the double-sided adhesive tape material, such as circular, square, triangular and the like in any selected size.

Figure 8:
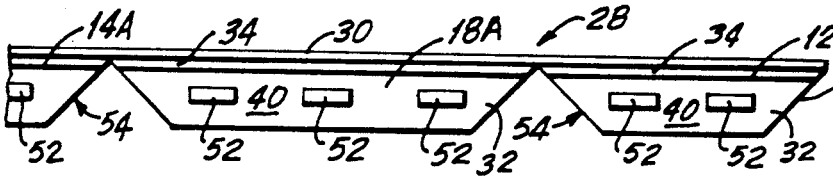
FIG. 8 is a fragmented plan view showing the one leg of FIG. 7 notched at selected intervals.

Once the double-sided adhesive tape material is secured, such as the tape materials 52, the leg 32 of the plastic strip 28 is notched in a predetermined manner, as shown in FIG. 8, to form the above mentioned frame portions. A special commercially available tool (not shown) is used to form the notches 54 in the leg 32, where this tool also cuts through the rib 34 when making the notch 54 so that the separated ribs 34 are formed on the leg 30. The notches 54 are spaced apart a predetermined distance to provide the selected length of the upper frame portion 12A, the side frame portion 18A, the lower frame portion 14A and the other side frame portion, where the leg 30 joins these separated frame portions together.

It is noted, that the leading edge 56 on the upper frame portion 12A is also formed by this tool when the leg 30 is cut at this leading edge 56. The leg 30 is also cut by this tool at the trailing edge of the side frame portion, such as the trailing edge 58 of the side frame portion 16 shown in FIG. 10, so that a strip length of the four frame portions connected together is formed. Thus, the tool in one operation cuts the trailing edge 58 of one strip length of four frame portions and also cuts the leading edge 56 of the succeeding strip length of four frame portions, and thereafter the leg 30 is cut to at these leading and trailing edges to separate the strip lengths.

Figure 9:
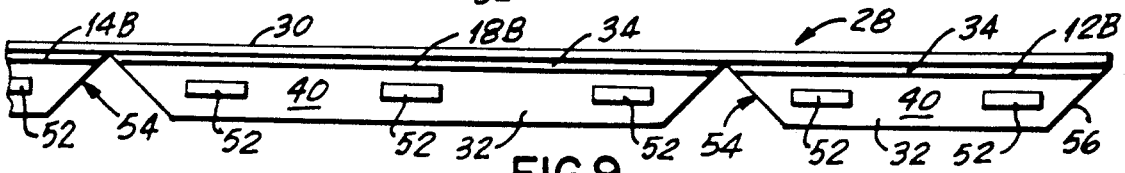
FIG. 9 a fragmented top plan view similar to FIG. 8 showing the one leg of FIG. 7 notched at larger selected intervals.
Figure 10:
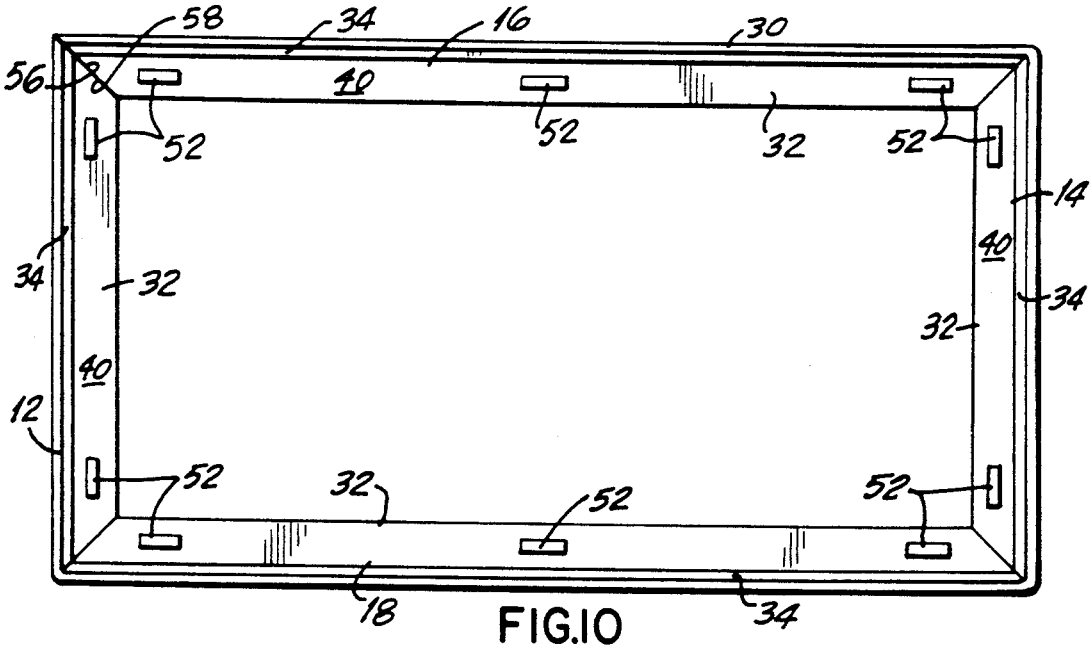
FIG. 10 is a plan view of an interior surface of the constructed frame portions of the picture frame of FIG. 1.

FIG. 9 is similar to FIG. 8 except the frame portions are made larger by increasing the predetermined distance between the notches 54. Thus, the upper frame portion 12B is larger than the upper frame portion 12A, the side frame portion 18B is larger than the side frame portion 18A, and so on. Obviously, the frame portions can be made as large as required where the frame portions shown in FIG. 10 are even larger than the frame portions 12B, 18B,14B, etc., shown in FIG. 9. The notches 54 provides edges that are at right angles to each other to permit the frame portions to be perpendicularly bent relative to each other to form the square shaped corners on the picture frame 10.

It is noted, that the double-sided adhesive tape material 38, 50 or 52 can either be secured on the leg 32 before the leg 32 is notched as described above, or can be secured on each of the legs 32 after the leg 32 is notched, such being determined by the particular processing thereof.

Figure 11:
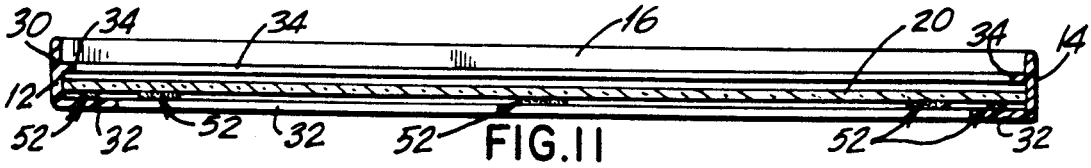
FIG. 11 is a cross sectional view of the constructed frame portions shown in FIG. 10, showing the picture frame glass installed thereon.

Accordingly, the strip of the four frame portions are now bent at each of the three notches 54 therein so that the leading edge 56 of the upper frame portion 12 abuts against the trailing edge 58 of the side frame portion 16 to form a rectangular-shaped construction as shown in FIG. 10. Usually a holding device (not shown) is used to maintain this rectangular-shaped construction in order to receive the picture frame glass 20 therein where the picture frame glass 20 has a predetermined rectangular-shaped construction to match the bent shape of the leg 30. However, before the picture frame glass 20 is positioned on the legs 32 of the frame portions, the peel-off liner 48 is removed from each of the tape materials 52. The picture frame glass 20 is now positioned over the inner surface 40 of the each leg 32 within the confines of the leg 30, and then the picture frame glass 20 is pushed down past the ribs 34 onto the outer adhesive 44 of the tape materials 52 to be adjacent to the inner surface 40 of each leg 32, as shown in FIG. 11.

Depending upon the resiliancy of the ribs 34, it may be difficult to push the picture frame glass 20 past the ribs 34. In this case, the upper frame portion 12 or the side frame portion 16 is left ajar so that the picture frame glass 20 can be slid into the space enclosed by the U-shaped construction formed by the three remaining frame portions, being inserted into the lower area disposed between the ribs 34 and the legs 32. Thereafter, the upper frame portion 12 or the side frame portion 16 is pivoted closed so that the leading edge 56 and trailing edge 58 abut each other as indicated in FIG. 10 to now form the rectangular-shaped construction. Thereafter, the picture frame glass 20 is firmly pushed down against the outer adhesive 44, where the peel-off liner 48 has already been removed, as shown in FIG. 11. Thus, the double-sided adhesive tape material 38, 50 or 52 secures the picture frame glass 20 to the legs 32 of the frame portions, and therefore maintains the frame portions in the rectangular-shaped construction, where the shear strength of the adhesives 44, 46 prevent the frame portions from being pulled apart, and/or from being separated from the picture frame glass 20.

Figure 12:
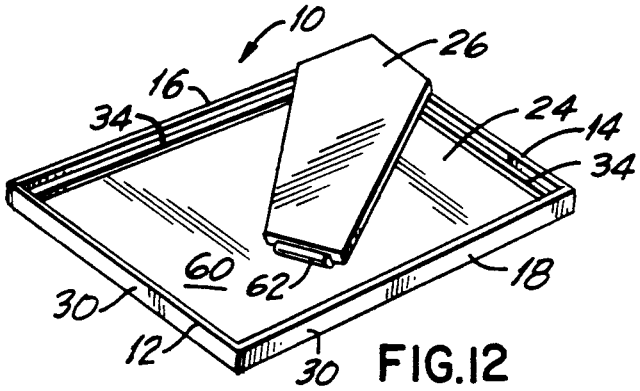
FIG. 12 is a perspective view showing the rear of the picture frame of FIG. 1, and more particularly showing the back plate thereof.
Figure 14:
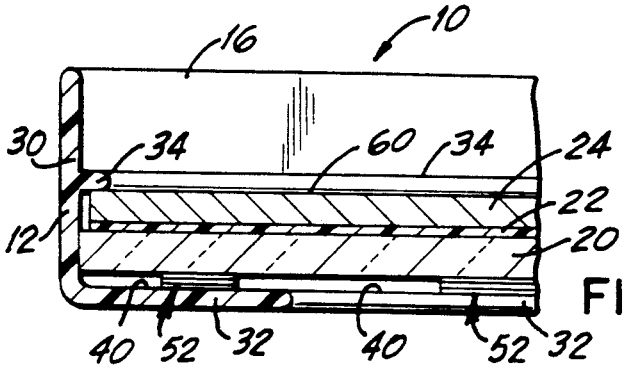
FIG. 14 is a fragmented cross sectional view of the picture frame, and more particularly showing the back plate removably secured therein.

The picture 22, or the like, fabricated from a suitable material such as plastic, paper, etc., is now positioned face down against the inner surface of the picture frame glass 20, and the back plate 24 is locked in place against the picture 22 to maintain the preselected position of the picture 22, as indicated in FIG. 14. The back plate 24 has a rectangular configuration, as shown in FIG. 12, corresponding to the rectangular configurations of the picture frame glass 20 and the assembled frame portions, but being slightly smaller as shown in FIG. 14. The back plate 24 is fabricated from a suitable material well known in the art, such as compressable cardboard, plastic and the like. Preferably, as is customary in the art, the stand portion 26 is pivotally connected to the back 60 of the back plate 24 by a conventional hinge 62 to permit the picture frame 10 to be maintained in a standing position as shown in FIG. 1.

Figure 13:
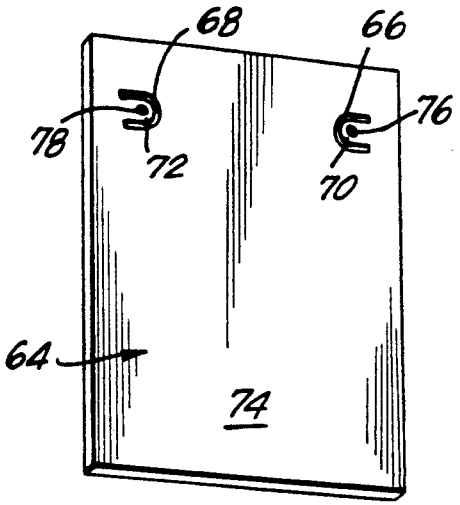
FIG. 13 is a perspective view of the rear surface of a modified back plate.

FIG. 13 shows a modified back plate 64 which can be used either for the picture frame 10 or for a conventional photo frame. The back plate 64 has C-shaped cuts 66, 68 therein near the upper edge thereof to provide hinged ears 70, 72 therein. Accordingly, the ears 70, 72 can be pulled out perpendicularly away from the back 74 of the back plate 64, and in a conventional manner a string, cord or wire (not shown) can be secured through the holes 76, 78 in the ears 70, 72, respectively to permit the picture frame or photo frame to be mounted on a wall in a manner well known in the art.

It is noted, that once the picture 22 is positioned on the picture frame glass 20, the back plate 24 is then positioned on the ribs 34. Thereafter, the back plate 24 is pushed downwardly towards the picture frame glass 20 so that the back plate 24 is snapped in against the picture 22 in a locked position under the ribs 34, as shown in FIG. 14. As mentioned above, the ribs 34 are easily deformable and are fabricated from a plastic material so that the ribs 34 are flexible. The ribs extend outwardly from the leg 30 approximately 0.050 inches, and the ribs 34 have a rounded edge portion so that the back plate 24 can easily be pushed past the ribs 34.

It is noted, that due to the small size of the ribs 34, the ribs 34 will snap back to their perpendicular position relative to the leg 30 after the back plate 24 is pushed past the ribs 34. Furthermore, due to the compressability of the foam 42 of the tape material 38, 50, 52, the back plate 24 is able to be pushed downwardly to a position spaced below the ribs 34, which would also permit the ribs 34 to snap back to the perpendicular position relative to the leg 30. After the back plate 24 is released, the above mentioned compressed parts will resume their normal shape to push the back plate 24 up against the ribs 34.

Following the above procedure, the picture frame 10 can now be placed in a standing position for viewing. It is noted, that to replace the picture 22, it is only necessary to pull up on the back plate 24 or 64 past the ribs 34, which can be accomplished by either pulling on the stand portion 26 or on the string, cord or wire (not shown) which connects the ears 70, 72 of the back plate 64 together. Thereafter, the picture 22 is removed, a new picture is inserted, and the above procedure is repeated for inserting the back plate 24 or 64.

Figure 15:
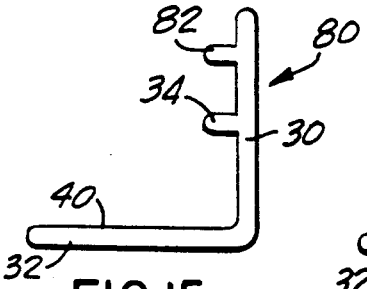
FIG. 15 is an end view of a modified extruded plastic strip having two back plate holding ribs thereon.

FIG. 15 shows a modified extruded plastic strip 80 similar to the above plastic strip 28 except for an additional rib 82 disposed above the rib 34. In this embodiment, either the above mentioned picture 22 and back plate 24, 64 can be held in place by the ribs 34 in the manner mentioned above, or a thicker picture and/or a thicker back plate can be used where the upper ribs 82 would be engaged on top of the back plate. Accordingly, the ribs 34 in the assembled arrangement would be deformed in a downward direction and would press against the edges of the back plate to additionally aid in holding the back plate in position. The rib 82 has the same size and shape as the rib 34.

Figure 16:
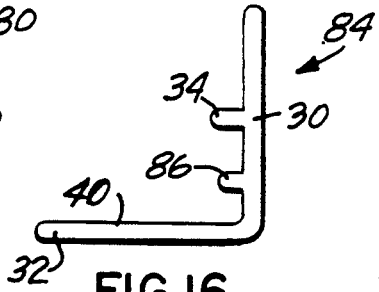
FIG. 16 an end view of a further modified extruded plastic strip having an additional rib for holding the picture frame glass.

FIG. 16 shows a further modified extruded plastic strip 84 which is the same as the above mentioned plastic strip 28 except for an additional rib 86 provided on the leg 30 below the rib 34 and spaced above the leg 32. The rib 86 is shorter than the rib 34. The function of the rib 86 will be explained below.

Figure 17:
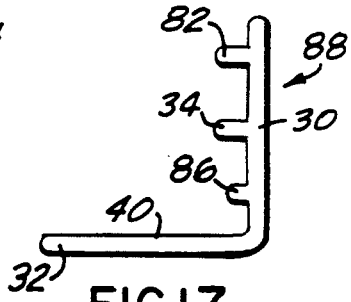
FIG. 17 is an end view of a still further modified extruded plastic strip having two ribs for holding the back plate and one rib for holding the picture frame glass.

FIG. 17 shows a still further modified extruded plastic strip 88 which is a combination of the above mentioned plastic strips 80 and 84. In this embodiment, the leg 30 is provided with the above mentioned ribs 34, 82 and 86 which function in the same manner as mentioned above and as will be mentioned below. It is noted, that though only two back plate holding ribs 34 and 82 have been shown, additional back plate holding ribs can be added to the leg 30 so that the leg 30 can have one, two or as many back plate retaining ribs as desired.

Figure 18:
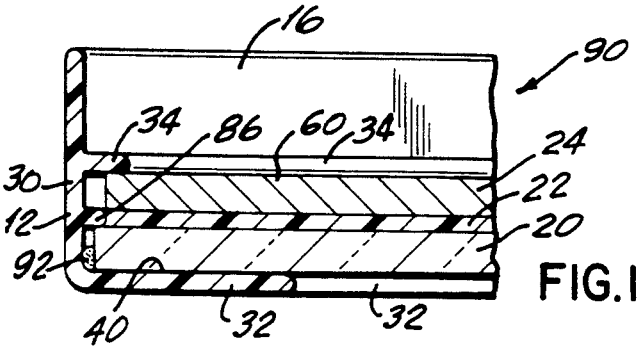
FIG. 18 is a fragmented sectional view showing the modified executed plastic strip of FIG. 16 being used to hold both the picture frame glass and the back plate.

FIG. 18 shows the extruded plastic strip 84 of FIG. 16 after it has been notched and cut to form a strip length of four frame portions, and the cut strip length has been bent to pivot the frame portions into a rectangular configuration in the manner mentioned above, to form a modified picture frame 90 or photo frame. With one of the frame portions in the ajar position as indicated above, the picture frame glass 20 is forced to slide in the space between the ribs 86 and the legs 32 of the U-shaped configuration formed by the three remaining frame portions. The space between the ribs 86 and the legs 32 is predetermined to be slightly smaller than the thickness of the picture frame glass 22 so that a friction force-fit engagement is achieved when the picture frame glass 22 is inserted therein.

Thereafter, the ajar frame portion, such as the above mentioned upper frame portion 12, is pivoted closed so that the leading edge 56 and the trailing edge 58 abut each other as indicated above in FIG. 10 to now form the rectangular-shaped construction. However, if additional holding strength is required to prevent the frame portions from being pulled apart or from separting from the picture frame glass 20, securing means such as glue 92 or the like can be applied during the assembly thereof between the frame portions and the picture frame glass 20 to provide the needed additional holding strength.

The picture 22 or the like can now be positioned face down against the inner surface of the picture frame glass 20, and the back plate 24, 64 can then be locked in place against the picture 22 to maintain the position of the picture 22. Thus, the picture frame 90 or photo frame can now be placed in a standing or hanging position in the same manner as mentioned above.

Numerous alterations of the structure herein discussed will suggest themselves to those skilled in the art. However, it is to be understood that the present disclosure relates to preferred embodiments of the invention which are for the purpose of illustration only, and are not to be construed as limitations of the invention.

What is claimed is:

1. A picture frame comprising:

an extruded plastic strip having an L-shaped construction to provide first and second legs perpendicular to each other, said second leg being notched at spaced apart intervals to permit said extruded plastic strip to be perpendicularly bent at said intervals to provide an upper frame portion, a lower frame portion and side frame portions connected together by said first leg in a rectangular configuration;

a picture frame glass;

first means for securing said picture frame glass to inner surfaces of said second leg to maintain said rectangular configuration, to prevent said frame portions from being pulled apart, and to prevent said picture frame glass from being separated from said frame portions;

said first means including a double-sided adhesive tape material disposed along said inner surfaces of said second leg of each of said frame portions and against associated portions of said picture frame glass;

a back plate; and second means provided on said first leg for engaging said back plate to removably lock said back plate in place against a picture disposed on an inner surface of said picture frame glass to maintain the picture in a preselected position.

2. A picture frame according to claim 1, wherein said tape material has a width corresponding to a width of said second leg.

3. A picture frame according to claim 1, wherein said tape material has a width narrower than a width of said second leg.

4. A picture frame according to claim 1, wherein said tape material includes longitudinally spaced apart double-sided adhesive tabs.

5. A picture frame according to claim 1, wherein said first means includes a rib projecting inwardly from said first leg of each of said frame portions and engaging edge portions of said inner surface of said picture frame glass.

6. A picture frame according to claim 1, wherein said second means includes a resilient rib projecting inwardly from said first leg of each of said frame portions to permit said back plate to be snapped into position against the picture.

7. A picture frame according to claim 6, wherein said second means includes a second resilient rib projecting inwardly from said first leg of each of said frame portions, said second resilient rib being transversely spaced from said first mentioned resilient rib.

8. A picture frame according to claim 6, wherein said first means includes a second rib projecting inwardly from said first leg of each of said frame portions and engaging edge portions of said inner surface of said picture from glass.

9. A picture frame according to claim 1, wherein said extruded plastic strip encapsulates a metallic stripe therein.

10. A picture frame comprising:

an extruded plastic strip having an L-shaped construction to provide first and second legs perpendicular to each other, said second leg being notched at spaced apart intervals to permit said extruded plastic strip to be perpendicularly bent at said intervals to provide an upper frame portion, a lower frame portion and side frame portions connected together by said first leg in a rectangular configuration:

a picture frame glass;

first means for securing said picture frame glass to inner surfaces of said second leg to maintain said rectangular configuration, to prevent said frame portions from being pulled apart, and to prevent said picture frame glass from being separated from said frame portions:

said first means including glue disposed between said frame portions and said picture frame glass;

a back plate; and second means provided on said first leg for engaging said back plate to removably lock said back plate in place against a picture disposed on an inner surface of said picture frame glass to maintain the picture in a preselected position.

11. A picture frame according to claim 10, wherein said second means includes a resilient rib projecting inwardly from said first leg of each of said frame portions to permit said back plate to be snapped into position against the picture.

12. A picture frame according to claim 11, wherein said first means includes a second rib projecting inwardly from said first leg of each of said frame portions and engaging edge portions of said inner surface of said picture frame glass.

13. A picture frame according to claim 11, wherein said second means includes a second resilient rib projecting inwardly from said first leg of each of said frame portions, said second resilient rib being transversely spaced from said first mentioned resilient rib.

14. A picture frame according to claim 10, wherein said extruded plastic strip encapsulates a metallic strip therein.

15. A picture frame according to claim 10, wherein said first means includes a rib projecting inwardly from said first leg of each of said frame portions and engaging edge portions of said inner surface of said picture frame glass.

* * * * *